US009730532B2

(12) United States Patent
Siamer

(10) Patent No.: US 9,730,532 B2
(45) Date of Patent: Aug. 15, 2017

(54) SYSTEM FOR DISTRIBUTING GAS CYLINDERS, INCLUDING MEANS FOR IDENTIFYING THE TYPE OF CYLINDER, COMPRISING A COLOR SENSOR AND A SENSOR FOR DETECTING FERROMAGNETIC MATERIAL

(75) Inventor: Yanis Siamer, Rueil Malmaison (FR)

(73) Assignee: FINAGAZ, Puteaux (FR)

( * ) Notice: Subject to any disclaimer, the term of this patent is extended or adjusted under 35 U.S.C. 154(b) by 912 days.

(21) Appl. No.: 14/124,146

(22) PCT Filed: Jun. 11, 2012

(86) PCT No.: PCT/EP2012/060998
§ 371 (c)(1),
(2), (4) Date: Feb. 7, 2014

(87) PCT Pub. No.: WO2012/171873
PCT Pub. Date: Dec. 20, 2012

(65) Prior Publication Data

US 2014/0163727 A1 Jun. 12, 2014

(30) Foreign Application Priority Data

Jun. 15, 2011 (FR) ..... 11 55223

(51) Int. Cl.
*G01M 99/00* (2011.01)
*A47F 7/28* (2006.01)
*G07F 7/06* (2006.01)

(52) U.S. Cl.
CPC ..... *A47F 7/283* (2013.01); *G07F 7/0609* (2013.01)

(58) Field of Classification Search
None
See application file for complete search history.

(56) References Cited

FOREIGN PATENT DOCUMENTS

| | | |
|---|---|---|
| EP | 1 494 180 A1 | 1/2005 |
| FR | 2 757 249 A1 | 6/1998 |

*Primary Examiner* — Robert R Raevis
(74) *Attorney, Agent, or Firm* — Pearne & Gordon LLP

(57) ABSTRACT

This system (10) for distributing gas cylinders, wherein the gas cylinders (11) are likely to be of different types defined by different shapes, volumes and colors, comprises means (20) for identifying the type of gas cylinder (11), the identification means (20) comprising a first sensor (60) for sensing the color of the gas cylinder. The identification means (20) also include a sensor (62) for detecting ferromagnetic material.

13 Claims, 2 Drawing Sheets

SYSTEM FOR DISTRIBUTING GAS CYLINDERS, INCLUDING MEANS FOR IDENTIFYING THE TYPE OF CYLINDER, COMPRISING A COLOR SENSOR AND A SENSOR FOR DETECTING FERROMAGNETIC MATERIAL

BACKGROUND OF THE INVENTION

The present invention relates to a system for distributing gas cylinders, the gas cylinders being able to be of different types defined by different shapes, volumes and colors, the system including identification means for identifying the type of the gas cylinder, the identification means including a first color sensor for sensing the color of the gas cylinder.

The present invention also relates to a method for identifying the type of a gas cylinder of such a distribution system.

Known from document EP 1,494,180 A1 is a distribution system of the aforementioned type. The system includes a terminal and a storage device. The terminal includes a receiving compartment capable of receiving an empty cylinder and transport means able to move the empty cylinder from the receiving compartment to a storage area. Identification sensors make it possible to identify the type of empty cylinder, in particular its shape and color, the shape determining the cylinder type and the color determining the brand and/or the type of gas. These sensors are in particular optoelectronic cells. Furthermore, the sensors may comprise or have added sensors capable of reading electronic or radio transmission chips, so as to identify the gas cylinders equipped with such chips.

However, the identification of the type of a gas cylinder not including an electronic or radio transmission chip is not very precise, and may cause detection errors during the return of the cylinder.

SUMMARY OF THE INVENTION

The aim of the invention is to propose a system for distributing gas cylinders comprising means for identifying the gas cylinder allowing more precise identification of a cylinder provided by a user, while limiting the costs of the system.

It in particular makes it possible to distinguish, upon return of an empty cylinder, whether the latter is part or not of the line of cylinders sold, without physical intervention by the operator on the site where such a system is installed.

To that end, the invention relates to a distribution system of the aforementioned type, wherein the identification means further include a detection sensor for detecting ferromagnetic material.

According to other embodiments, the distribution system comprises one or more of the following features, considered alone or according to any technically possible combinations:

- the detection sensor comprises a first electromagnetic coil capable of emitting a magnetic field around it when a predetermined current circulates in said first coil, means for supplying the first coil with said predetermined current, a second electromagnetic coil, a current being able to be induced in the second electromagnetic coil under the influence of a magnetic field reflected by the gas cylinder whereof the type is to be identified from the magnetic field emitted by the first coil, and means for measuring the current induced in the second electromagnetic coil,

- the detection sensor is capable of measuring the amplitude of the induced current,
- the detection sensor is capable of measuring the phase shift between the current induced in the second electromagnetic coil and the predetermined current capable of circulating in the first electromagnetic coil,
- the identification means include at least one second color sensor for sensing the color of the gas cylinder, the two color sensors being able to determine the color of the cylinder at different points,
- the distribution system includes a display case including multiple gas cylinder lockers, each locker having an open position in which the gas cylinder is accessible and a closed position in which the gas cylinder is retained in the locker, and a control terminal of the display case able to control opening of a locker, the control terminal and the display case being remote and connected by a data link, and the control terminal includes the detection sensor and the color sensor(s),
- the control terminal extends in a vertical direction, and the electromagnetic coils extend in a vertical plane,
- the electromagnetic coils have a height greater than or equal to 25 cm, preferably equal to 30 cm, and
- the distribution system further includes means for measuring the mass of the gas cylinder and means for determining the quantity of residual gas in the gas cylinder.

The invention also relates to a method for identifying the type of a gas cylinder of a system for distributing gas cylinders, the gas cylinders being able to be of different types defined by different shapes, volumes and colors, the method including a first measurement of the color of the gas cylinder using a first color sensor for sensing the color of the cylinder, wherein the method further includes at least one measurement of a quantity of ferromagnetic material of the gas cylinder using a detection sensor for detecting ferromagnetic material.

According to other embodiments, the identification method includes one or more of the following features, considered alone or according to any technically possible combinations:

- the identification method further includes a second measurement of the color of the gas cylinder using a second color sensor for sensing the color of the gas cylinder, at a different point from that where the first measurement was done using the first color sensor, and
- the identification method further includes measuring the mass of the gas cylinder and determining the quantity of residual gas in the gas cylinder.

BRIEF DESCRIPTION OF THE DRAWINGS

These features and advantages of the invention will appear upon reading the following description, provided solely as an example, and done in reference to the appended drawings, in which.

DETAILED DESCRIPTION OF PREFERRED EMBODIMENTS OF THE INVENTION

Figure 1:
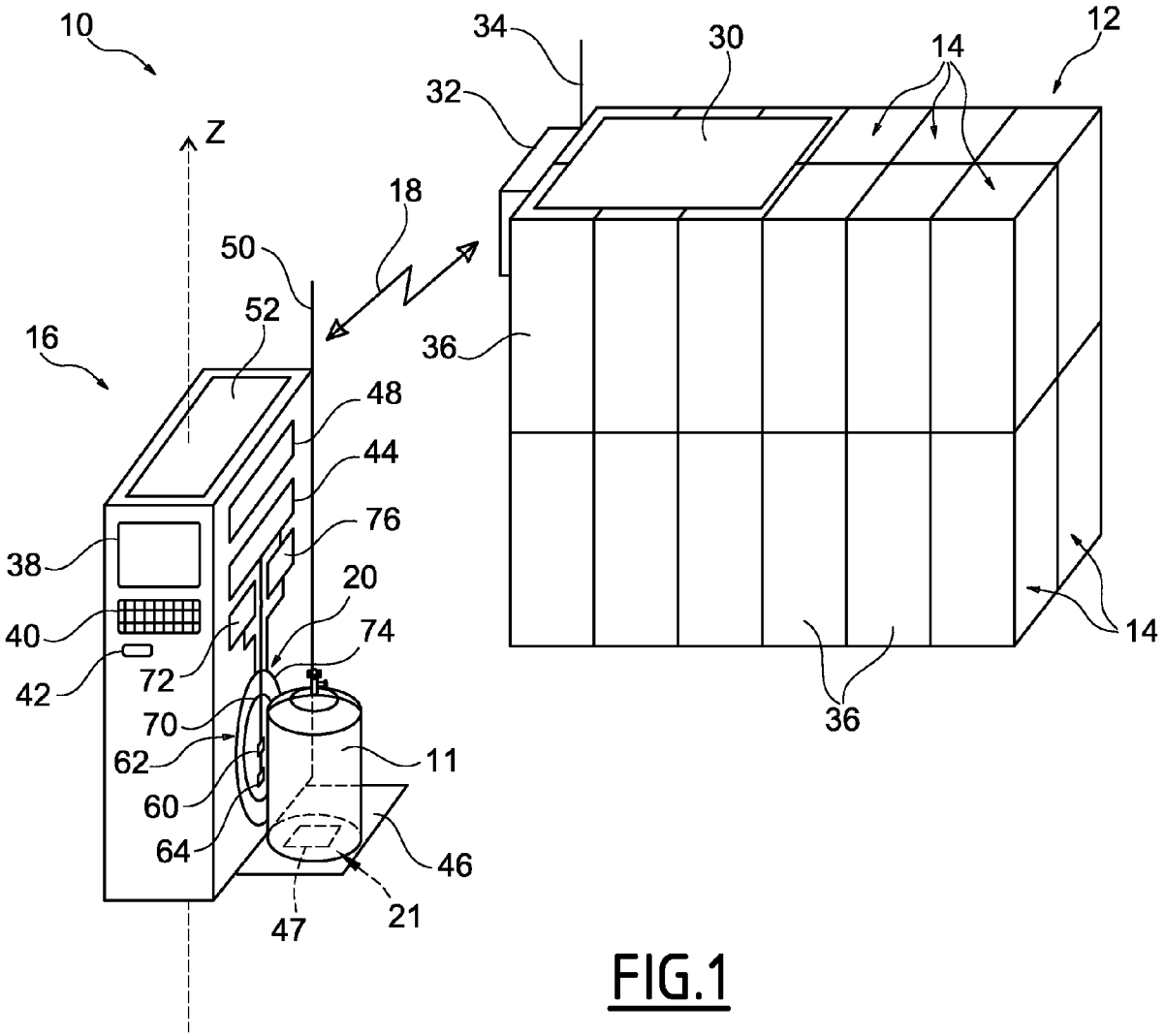
FIG. 1 is a diagrammatic illustration of the system for distributing gas cylinders according to the invention including a display case and a control terminal of the display case.

In FIG. 1, a system 10 for distributing gas cylinders 11 includes a display case 12 comprising multiple lockers 14 for gas cylinders, and a control terminal 16 of the display case, the control terminal 16 and the display case 12 being distant and connected by a data link 18.

Additionally, the distribution system 10 includes multiple display cases 12.

The gas cylinders 11 may be of different types defined by different shapes, volumes, colors and materials, so as to meet market requirements, but also with the aim of differentiating the products and brands of different gas cylinder distributors.

The gas cylinders 11 are capable of containing a gas mass varying between 5 and 35 kg.

The gas cylinders 11 are generally cylindrical. Alternatively, the gas cylinders are cube-shaped.

The gas cylinders 11 are made from steel. Alternatively, the gas cylinders are made from composite materials.

The gas cylinders 11 have one or more colors based on the product contained (butane/propane) and the brand of the distributor or owner of the gas cylinders. More than 30 different cylinders exist on the French market.

The distribution system 10 includes identification means 20 for identifying the type of the gas cylinder, the identification means 20 being capable of identifying the type of the cylinder provided by a user. In the example embodiment of FIG. 1, the control terminal 16 includes the identification means 20. Alternatively, the identification means 20 are arranged in the display case 12.

Additionally, the distribution system 10 includes measuring means 21 for measuring the mass of the gas cylinder 11. In the example embodiment of FIG. 1, the control terminal 16 comprises measuring means 21. Alternatively, the measuring means 21 are arranged in the display case 12.

Figure 2:
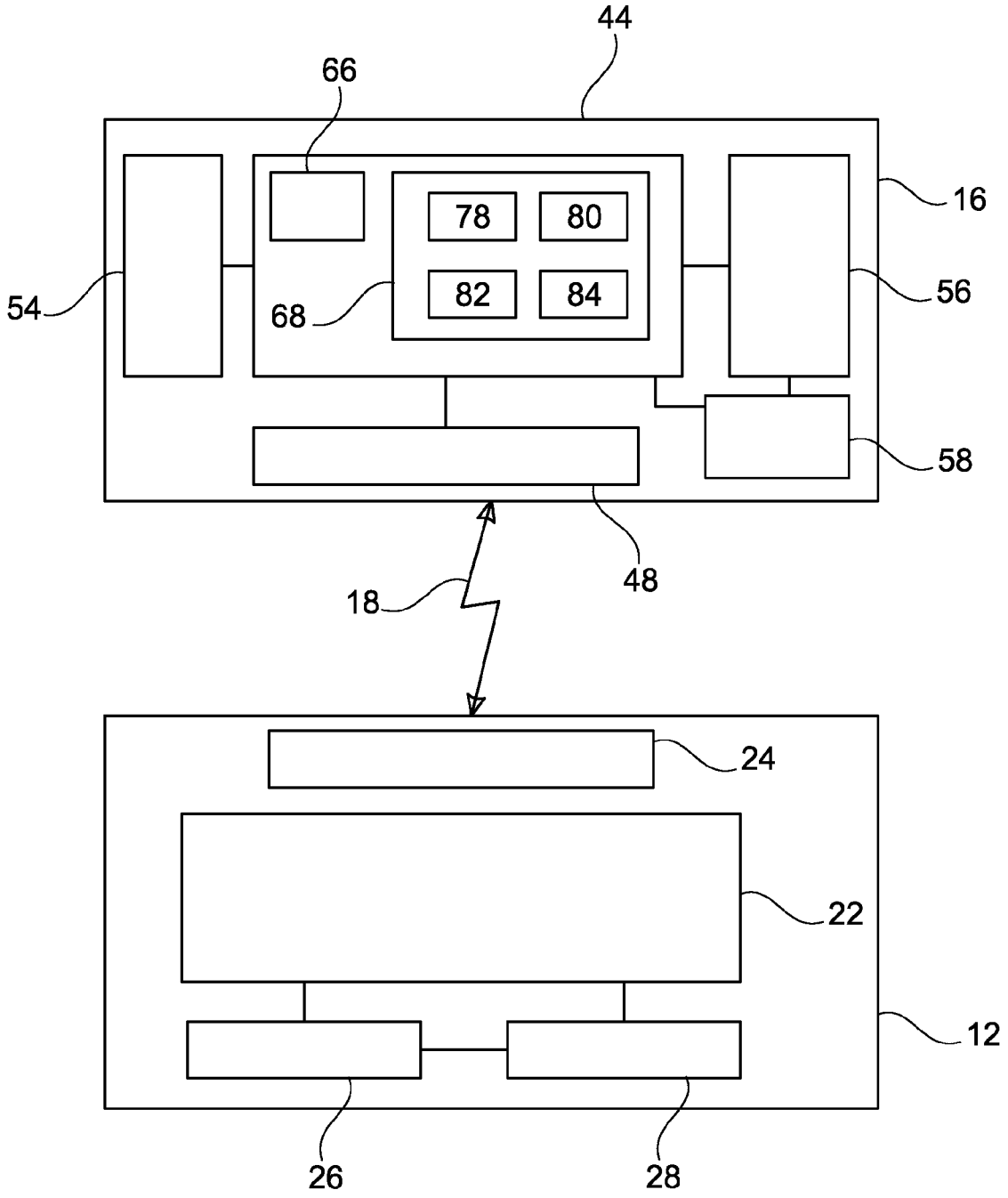
FIG. 2 is a diagrammatic illustration of certain elements of the terminal and the display case of FIG. 1.

Each display case 12 comprises, as shown in FIG. 2, a processing unit 22 and a wireless transceiver 24, the data link 18 between the control terminal and each display case for example being a wireless connection, in the absence of a wired data link between the control terminal and the respective display case.

Each display case 12 includes independent power supply means comprising a rechargeable electric battery 26 and means 28 for recharging the battery. The processing unit 22 is connected to the recharging means 28 to control them, and to the rechargeable battery 26 so as to be electrically powered by the latter. The power supply means of the display case include a solar panel 30, visible in FIG. 1, arranged on top of the display case electrically connected to the recharging means 28.

Each display case 12 includes a protective housing 32, shown in FIG. 1, in which the processing unit, the transceiver, the rechargeable battery and the means for recharging the battery are arranged. Each display case 12 also includes a wireless antenna 34.

In the example embodiment of FIG. 1, each display case 12 does not comprise any wired connection with an outside device, each display case 12 being independent in terms of energy owing to its rechargeable battery 26, and communicating with the control terminal 16 by means of its wireless transceiver 24 via the wireless connection 18.

In the example embodiment of FIG. 1, each display case 12 includes twenty-four cylinder lockers 14.

Each locker 14 has an open position, in which the gas cylinder is accessible, and a closed position, in which the gas cylinder is retained in the locker. Each locker 14 is for example equipped with a door 36 and means, not shown, for locking the door, such as an electric door opener known in itself.

Each cylinder locker 14 is suitable, due to its dimensions, for receiving any type of gas cylinder, irrespective of the volume thereof.

The control terminal 16 is capable of controlling the opening of the locker 14, and includes a screen 38, means 40 for entering characters, and means 42 for accepting payment methods, such as a coin tester and/or a payment card reader. The control terminal 16 includes a processing unit 44.

In the example embodiment of FIG. 1, the control terminal 16 includes the identification means 20 and a pedestal 46 for receiving the gas cylinder in order to identify its type, the identification means 20 being connected to the processing unit 44.

Additionally, in the example embodiment of FIG. 1, the control terminal 16 includes a measuring sensor 47 for measuring the mass of the gas cylinder 11 for weighing thereof, the measuring sensor 47 forming the measuring means 21 being arranged in the receiving pedestal 46 and connected to the processing unit 44.

In the example embodiment of FIG. 1, the control terminal 16 includes a wireless transceiver 48 and wireless antenna 50 for the data link 18 with the display case.

The control terminal 16 for example includes a solar panel 52 arranged on top of the control terminal and intended to supply electricity to the terminal.

The control terminal 16 extends in a vertical direction Z.

In FIG. 2, the control terminal 16 includes means 54 for displaying data on the screen and independent power supply means including a rechargeable electric battery 56 and means 58 for recharging the battery, electrically connected to the solar panel 52.

Alternatively, the control terminal 16 is connected to a power supply grid; the power supply means then comprising a voltage transformer.

In the example embodiment of FIG. 1, the control terminal 16 does not include any wired connection with an outside device, the control terminal 16 being independent in terms of energy due to its rechargeable battery 56 and communicating with the display case 12 via the wireless link 18 by means of its wireless transceiver 48.

The data link 18 between the control terminal and the display case is for example a wireless link, also called an unwired link. In the example embodiment of FIGS. 1 and 2, the wireless link 18 is for example in accordance with standard IEEE 802.11, and is also called Wi-Fi connection. Alternatively, the wireless link 18 is according to the ZigBee communication protocol based on standard IEEE-802.15.4.

Alternatively, the data link 18 is a wired data link.

The means for identifying the type of cylinder 20, shown in FIG. 1, comprise a first color sensor 60 sensing the color of the gas cylinder and a detection sensor 62 for detecting ferromagnetic material.

Additionally, the identification means 20 include a second color sensor 64 for sensing the color of the gas cylinder, the two color sensors 60, 64 being able to determine the color of the gas cylinder in different locations.

The processing unit 22 of the display case is able to process a request emitted by the control terminal 16, and to emit a response intended for the control terminal.

The transceiver 24 of the display case is according to the communication standard for the wireless connection 18, and is for example in accordance with standard IEEE 802.11, the transceiver 24 also being called Wi-Fi transceiver. Alternatively, the transceiver 24 is according to the ZigBee communication protocol based on standard IEEE-802.15.4.

The processing unit 44 of the control terminal for example comprises a data processor 66 associated with a memory 68, as shown in FIG. 2.

The transceiver 48 of the control terminal is accordance with the communication standard of the wireless connection 18, and is for example in accordance with standard IEEE 802.11, the transceiver 48 also being called a Wi-Fi transceiver. Alternatively, the transceiver 48 is accordance with the ZigBee communication protocol based on standard IEEE 802.15.4.

The display means 54 are in particular capable of displaying a man-machine interface for user interaction with the control terminal 16.

The first and second color sensors 60, 64 for example include optoelectronic cells known in themselves. The first and second color sensors 60, 64 are connected to the processing unit 44 of the control terminal. The first color sensor 60 is positioned at a distance comprised between 30 and 50 cm from the receiving pedestal 46 in the vertical direction Z, and the second color sensor 64 is positioned at a distance of 15 cm from the receiving pedestal 46 in the vertical direction Z.

The ferromagnetic material detection sensor 62, shown in FIG. 1, comprises a first electromagnetic coil 70 capable of emitting a magnetic field around it when a predetermined current circulates in said first coil, and means 72 for supplying the first coil with said predetermined current.

The ferromagnetic material detecting sensor 62 includes a second electromagnetic coil 74, a current being able to be induced in the second electromagnetic coil under the influence of a magnetic field reflected by the gas cylinder, the type of which is to be identified from the magnetic field emitted by the first coil, and means 76 for measuring the current induced in the second electromagnetic coil 74.

The memory 68 of the processing unit of the control terminal is capable of storing a file 78 for managing the inventory of gas cylinders, as well as software 80 for controlling the opening of a respective locker for the delivery of a full cylinder or the return of an empty cylinder. The memory 68 is also capable of storing software 82 for identifying the type of the gas cylinder.

Additionally, the memory 68 is capable of storing software 84 for determining the quantity of residual gas in a returned cylinder.

The electromagnetic coils 70, 74 of the detection sensor extend in the vertical plane, and have, in the vertical direction Z, a height greater than or equal to 25 cm, preferably equal to 30 cm.

The electromagnetic coils 70, 74 of the detection sensor are for example positioned concentrically.

The center of the electromagnetic coils 70, 74 of the detection sensor is positioned at a distance of 30 cm from the receiving pedestal 46 in the vertical direction Z.

The measuring means 76 are capable of measuring the amplitude of the induced current. The measuring means 76 are also capable of measuring the phase shift between the current induced in the second electromagnetic coil 74 and the predetermined current capable of circulating in the first electromagnetic coil 70.

The measuring means 76 are connected to the processing unit 44 of the control terminal.

The identification software 82 is capable of determining the type of the gas cylinder 11 based on information received from the first color sensor 60 and measuring means 76 of the ferromagnetic material detection sensor. Additionally, the identification software 82 is capable of determining the type of the gas cylinder 11 based on the information received from the second color sensor 64.

The determination software 84 is capable of determining the quantity of residual gas in a returned cylinder, by computing the difference between the mass of the gas cylinder measured using the measuring sensor 47 and a predetermined mass of the gas cylinder associated with the type of the gas cylinder 11 previously determined using the identification software 82. The predetermined mass corresponds to the empty mass of the gas cylinder 11 for the corresponding type of cylinder. The predetermined mass is for example stored in the memory 68.

The operation of the system for distributing gas cylinders will now be explained.

When a user approaches the control terminal 16 with an empty gas cylinder, in order to exchange it for a full cylinder or to recover the deposit corresponding to the empty cylinder, he places his cylinder 11 on the receiving pedestal 46. He interacts with the man-machine interface of the control terminal 16, so as to perform a cylinder exchange transaction or a deposit recovery transaction.

Additionally, when the control terminal 16 comprises means 21 for measuring the mass of the gas cylinder, the terminal 16 computes the quantity of residual gas in the returned cylinder using the determination software 84. The determination software 84 thus makes it possible to determine whether the cylinder is empty or not. When the cylinder 11 returned by the user is not empty, the terminal 16 then offers the user a credit on the purchase in progress and/or a reimbursement corresponding to the residual quantity of gas that was not used.

During each of these transactions, the control terminal 16 necessarily verifies the type of the gas cylinder, so as to ensure that the type of cylinder returned by the user indeed corresponds to the type of cylinder indicated by the user upon request by the control terminal.

The method for identifying the type of gas cylinder 11 then includes a first measurement of the color of the gas cylinder 11 using a first color sensor 60, as well as a measurement of a quantity of ferromagnetic material of the gas cylinder 11 using the ferromagnetic material detecting sensor 62.

Additionally, the identification method includes a second measurement of the color of the gas cylinder using the second color sensor 64 at a different point from that where the first measurement was done using the first color sensor 60.

After having verified the type of cylinder being returned, the control terminal 16 records all of the characteristics of the returned cylinder in the management log 84, and then commands opening of the locker 14 allocated to the return of that empty cylinder.

The user removes his empty cylinder from the receiving pedestal 46 and places it in the corresponding locker 14, then closes it.

In the case of a deposit recovery, the control terminal 16 then returns the deposit to the user, and completes the transaction.

In the case of a cylinder exchange, the control terminal 16 then determines a locker 14 containing a full gas cylinder corresponding to the user's selection, indicates that location to the user on the screen 38, then commands opening of the corresponding locker 14 using those control means 80.

The user then recovers his full cylinder, and closes the corresponding locker 14. When the locker 14 is closed, the control terminal 16 lastly establishes the new deposit corresponding to that new full cylinder for the user, and completes the transaction.

The correlation of the piece(s) of color information and the quantity of ferromagnetic material according to the invention makes it possible to determine the type of the gas cylinder 11 more reliably. In fact, certain gas cylinders of different types have very similar colors, such that it is sometimes difficult to distinguish them from one another using only the color information from the first color sensor 60.

Furthermore, the color information for the cylinder also depends on the manner in which the cylinder 11 is positioned relative to the first color sensor 60, the color of the cylinder not necessarily being identical over the entire periphery of the cylinder.

The second color sensor 64, which allows the detection of the color of the cylinder at a different location of the first sensor, then makes it possible to determine the type of the cylinder still more reliably, in particular when the cylinder has different colors based on its positioning relative to the sensor or based on the height at which the corresponding color sensor is placed.

The electromagnetic coils 70, 74 of the ferromagnetic detection sensor have a height greater than or equal to 50 cm, so as to be able to emit a magnetic field and respectively sense the magnetic field reflected by the cylinder over a majority of the height thereof.

One can see that the system for distributing gas cylinders according to the invention allows a more precise identification of a cylinder returned by user, while limiting costs.

The invention claimed is:

1. A system for distributing gas cylinders, the gas cylinders being able to be of different types defined by different shapes, volumes and colors, the system including identification means for identifying the type of the gas cylinder, the identification means including at least one color sensor for sensing the color of the gas cylinder, wherein the identification means further include a detection sensor for detecting ferromagnetic material.

2. The system according to claim 1, wherein the detection sensor comprises a first electromagnetic coil capable of emitting a magnetic field around it when a predetermined current circulates in said first coil, means for supplying the first coil with said predetermined current, a second electromagnetic coil, a current being able to be induced in the second electromagnetic coil under the influence of a magnetic field reflected by the gas cylinder whereof the type is to be identified from the magnetic field emitted by the first coil, and means for measuring the current induced in the second electromagnetic coil.

3. The system according to claim 2, wherein the detection sensor is capable of measuring the amplitude of the induced current.

4. The system according to claim 2, wherein the detection sensor is capable of measuring the phase shift between the current induced in the second electromagnetic coil and the predetermined current capable of circulating in the first electromagnetic coil.

5. The system according to claim 2, wherein the system includes a display case comprising multiple gas cylinder lockers, each locker having an open position in which the gas cylinder is accessible and a closed position in which the gas cylinder is retained in the locker, and a control terminal for the display case able to control opening of a locker, the control terminal and the display case being remote and connected by a data link, wherein the control terminal includes the detection sensor and the color sensor(s), and wherein the control terminal extends in a vertical direction, and the electromagnetic coils extend in a vertical plane.

6. The system according to claim 5, wherein the electromagnetic coils extend vertically a distance greater than or equal to 25 cm.

7. The system according to claim 5, wherein the electromagnetic coils extend vertically a distance equal to 30 cm.

8. The system according to claim 1, wherein the identification means include at least one second color sensor for sensing the color of the gas cylinder, the two color sensors being able to determine the color of the cylinder at different points.

9. The system according to claim 1, wherein it includes a display case comprising multiple gas cylinder lockers, each locker having an open position in which the gas cylinder is accessible and a closed position in which the gas cylinder is retained in the locker, and a control terminal for the display case able to control opening of a locker, the control terminal and the display case being remote and connected by a data link, wherein the control terminal includes the detection sensor and the color sensor(s).

10. The system according to claim 1, wherein it further includes means for measuring the mass of the gas cylinder and means for determining the quantity of residual gas in the gas cylinder.

11. A method for identifying the type of a gas cylinder of a system for distributing gas cylinders, the gas cylinders being able to be of different types defined by different shapes, volumes and colors, the method including at least one measurement of the color of the gas cylinder using at least one color sensor for sensing the color of the cylinder, wherein the method further includes at least one measurement of a quantity of ferromagnetic material of the gas cylinder using a detection sensor for detecting ferromagnetic material.

12. The method according to claim 11, wherein it further includes a second measurement of the color of the gas cylinder using a second color sensor for sensing the color of the gas cylinder, at a different point from that where the at least one measurement was done using the at least one color sensor.

13. The method according to claim 11, wherein it further includes measuring the mass of the gas cylinder and determining the quantity of residual gas in the gascylinder.

* * * * *